United States Patent [19]

Estenevy

[11] 4,332,098

[45] Jun. 1, 1982

[54] ELECTRIC CONTROL WEAPON, OPERATION AND AMMUNITION THEREFOR

[75] Inventor: Serge Estenevy, Saint Just-Saint Rambert, France

[73] Assignee: Centre Stephanois de Recherches Mecaniques Hydromecanique et Frottement, France

[21] Appl. No.: 66,057

[22] Filed: Aug. 13, 1979

[30] Foreign Application Priority Data

Aug. 11, 1978 [FR] France ..... 78 24227
Jun. 28, 1979 [FR] France ..... 79 17409

[51] Int. Cl.[3] ..... F41C 19/12; F42B 5/08
[52] U.S. Cl. ..... 42/84; 102/472
[58] Field of Search ..... 42/84, 74; 102/203, 102/218, 220, 46, 202.5, 472

[56] References Cited

U.S. PATENT DOCUMENTS

| | | | |
|---|---|---|---|
| 2,978,827 | 4/1961 | Rouby | 42/84 |
| 3,045,148 | 7/1962 | McNulty et al. | 102/218 |
| 3,613,282 | 10/1971 | Ramsay | 42/84 |
| 3,650,174 | 3/1972 | Nelson | 42/84 |
| 3,671,842 | 6/1972 | McKeown | 102/218 |
| 3,690,259 | 9/1972 | Piazza et al. | 102/218 |

*Primary Examiner*—Charles T. Jordan
*Attorney, Agent, or Firm*—Remy J. VanOphem

[57] ABSTRACT

The invention pertains to an electric control weapon.

A condenser is charged by a battery through an electrical circuit including an integrated circuit, a transistor, a transformer and a diode. As the trigger of a thyristor is activated, the condenser is suddenly discharged into an electrical cap of the cartridge, so as to fire it. This invention provides a more accurate and reliable weapon.

29 Claims, 47 Drawing Figures

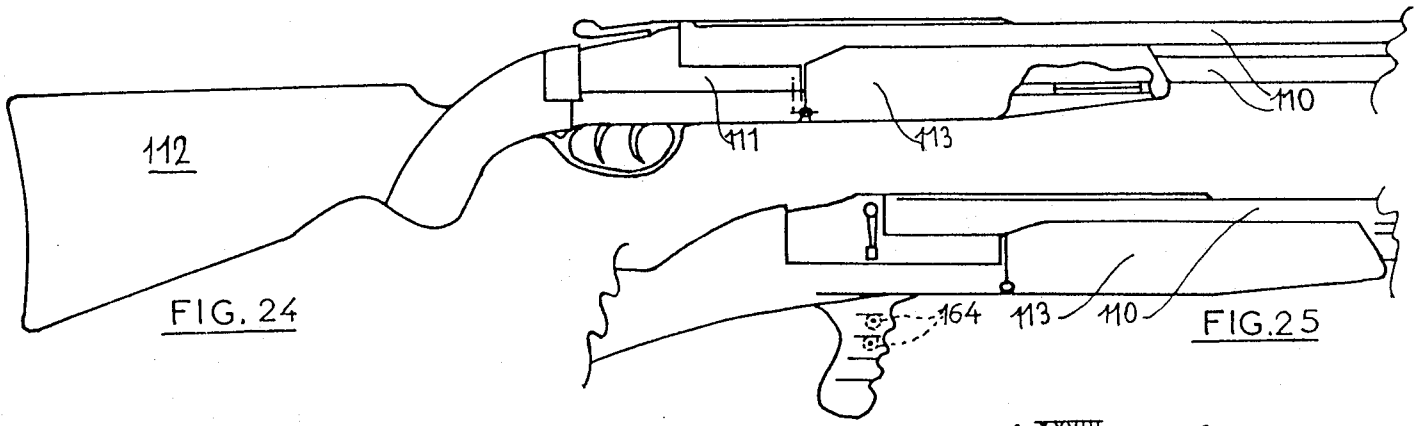
FIG. 24
FIG. 25
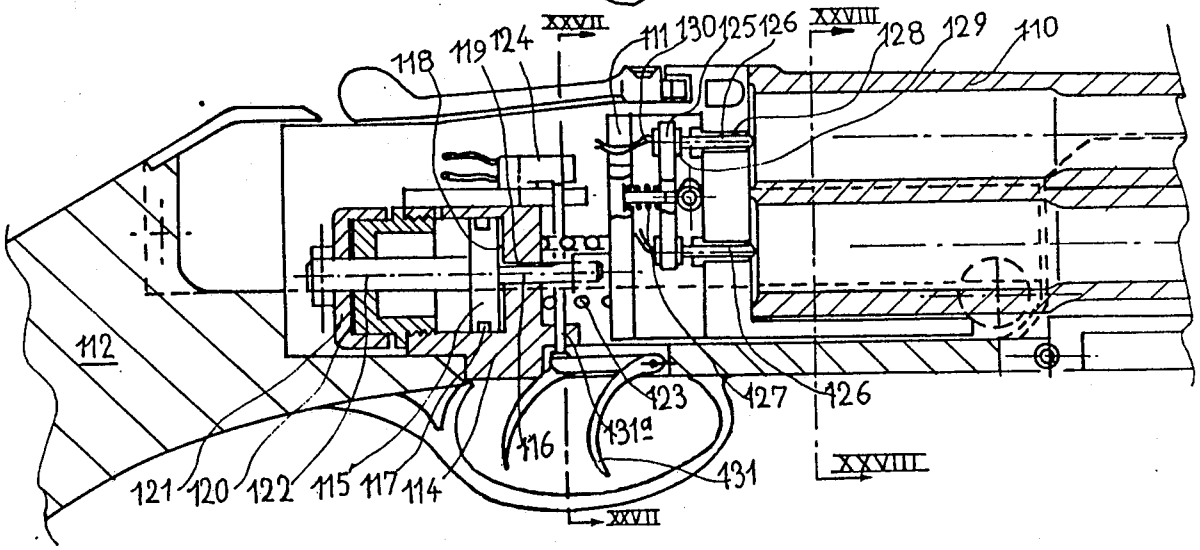
FIG. 26

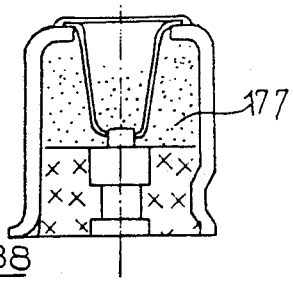
FIG. 38
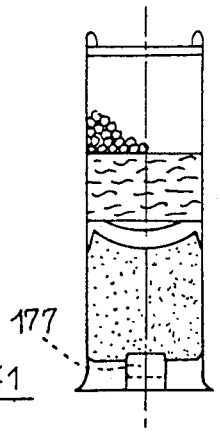
FIG. 41
FIG. 39
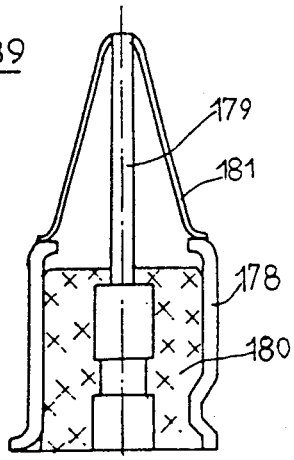
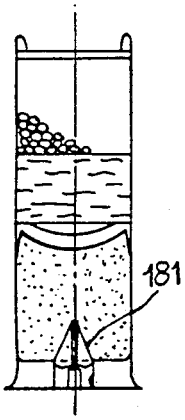
FIG. 42
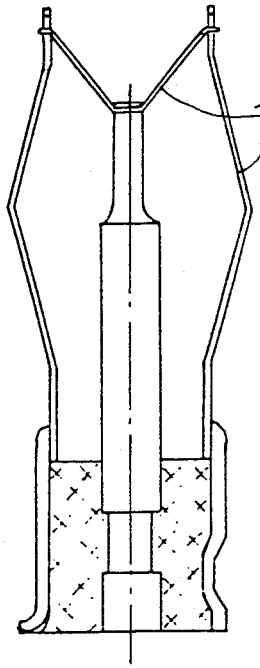
FIG. 40
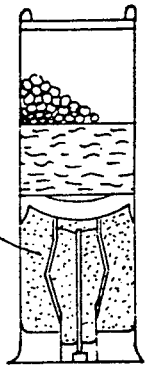
FIG. 43

FIG.44
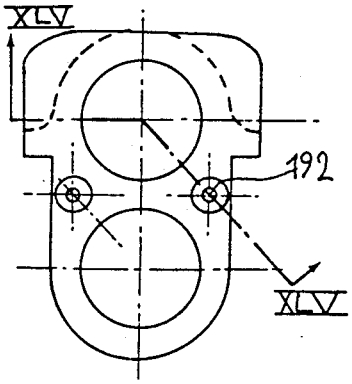
FIG.45
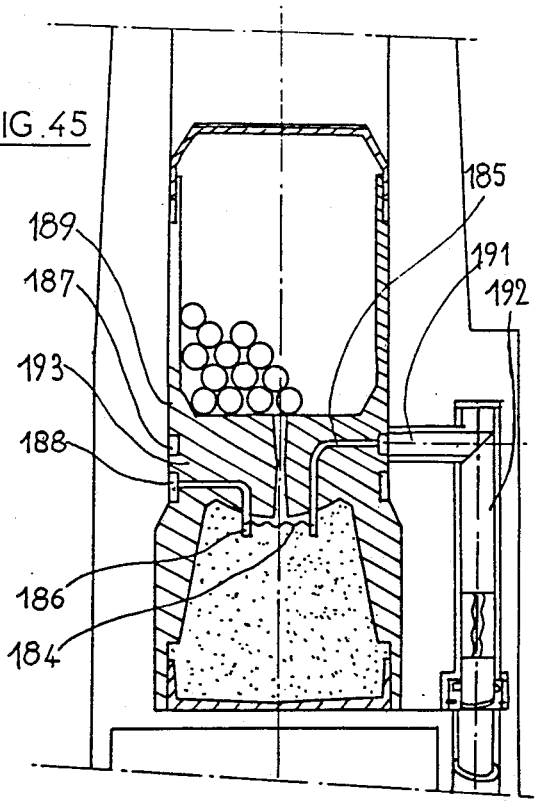
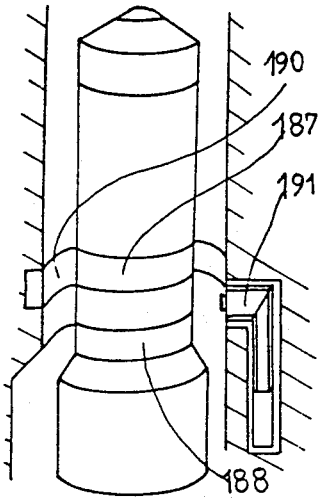
FIG.46
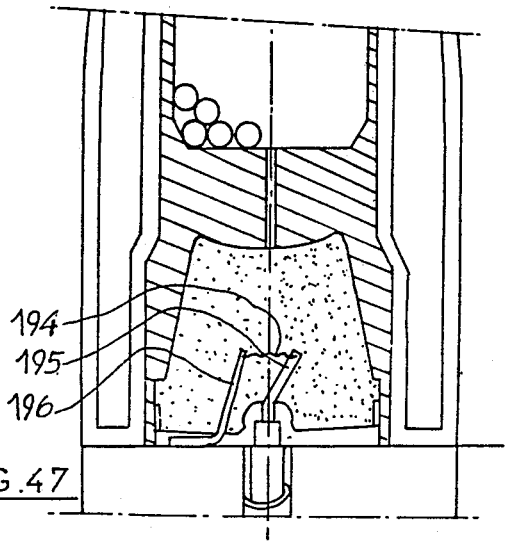
FIG.47

ELECTRIC CONTROL WEAPON, OPERATION AND AMMUNITION THEREFOR

BACKGROUND OF THE INVENTION

1. Field of the Invention

The present invention pertains to an electric control weapon, its operation and the ammunition required.

2. Description of the Prior Art

Electrical or electronic systems have already been advocated and successfully tested for the firing of a rifle.

These systems are popular, since they suppress a large part of the mechanism of the traditional rifles, the only remaining mechanism being the locking and extraction mechanism.

Therefore, the weapon is lighter and its price is reduced, even so it still uses the traditional ammunition, with some minor changes necessary.

But with all of these advantages, the electrical or electronic firing did not receive the expected success on the rifle market, and it is due to a lot of disadvantages concerning, in particular, the lack of reliability, as well as a doubtful safety. This lack of reliability stemmed from a large amount of misfirings, which were due in most instances to bad contacts, to the corrosion of the contacts, to the humidity and other reasons.

Furthermore, the time required to reload the firing system, made it impossible to fire two cartridges at a split second interval.

The lack of safety derived from the weakness of the effort required to activate the electrical, mechanical type button, as compared with the ordinary trigger. This electrical button included a mechanical component assembly, comparable to that of a switch, and under repeated shocks and sudden accelerations, the switch could close the circuit in an erratic fashion, thus causing the firing of the weapon.

The problem of the recoil is taking a larger place in the weapon industry. Before, the hunting rifle represented most of the production of that industry, and the very low shooting frequency at animals made the recoil of traditional weapons more acceptable, since it could be reduced by using an elastomer plate. Nowadays, the production of weapons for sport competitions, such as skeetshooting or trapshooting, makes it absolutely necessary to find a solution. A sportsman often shoots over 100 cartridges in one afternoon of competition, and this results in a growing pain in the shoulder which affects the accuracy of aim.

No convenient and satisfactory solution has been found today. Actually, the recoil break can only be efficient when there is a certain amount of gap between a moving part and a fixed part. But in the present percussion type weapons, there is a continuous kinematical chain which connects the percussion-mechanism-butt sub-assembly to the extraction-breech-barrel sub-assembly. This kinematical chain prevents the integration of the movement required to progressively reduce the recoil power.

The purpose of this invention is to build a weapon which will include all of these advantages, and which offers a significant amount of new advantages; it will also provide, on that weapon, a large number of effects leading to a better operation, a greater accuracy and a better shooting safety.

SUMMARY OF THE INVENTION

The invention also aims at the production of an electric control weapon of the above type which, furthermore, significantly reduces the recoil.

An electric control weapon according to the invention is characterized by the fact that it includes at least one DC generator, and at least one condenser charged by the same generator, as well as a static breaker of thyristor type, which is controlled by an adequate system so as to cause the discharge of the condensers by closing the electrical circuit on a resistance contacting the powder of the cartridge, so that this resistance be suddenly brought to incandescence in order to fire the powder.

According to another specification of the invention, the resistance is housed in the traditional cap of the cartridge, thus causing the cap to explode and the related firing of the cartridge.

According to a variation of the invention, the resistance is in direct contact with the powder of the cartridge, which does not include any cap.

According to another specification of the invention, the parts of the rifle that are used for the contact with the ammunition are made of a metal which offers the best insolubility diagram with the metal of the ammunition.

According to another specification of the invention, the weapon includes at least two accumulation systems, so that one at least is being charged as the other operates, so as to keep the rifle ready to shoot.

According to another specification of the invention, a light signal points the operating circuit to the user.

According to another specification of the invention, the electrical circuit includes, besides a firing contact, two complete circuit breakers, that is a first breaker which remains shut as long as the weapon is not locked, and a second breaker which remains shut as long as the hunter, ready to shoot, has not pulled the trigger.

According to another specification of the invention, the firing button is controlled by other motions then the traditional finger pressure on the trigger, and it can be controlled either by the pressure of the thumb on the upper part of the butt-end, or by the pressure of the shoulder on the rest-plate of the butt, or even by a tooth or eyelid motion.

According to the specification of the invention, the firing system is controlled outside of the rifle, either by a wire, or by a radio.

According to another specification of the invention, the weapon includes an infra-red sight-vane, sensitive to the animal's heat, or a sound receiver which is sensitive to the noise made by the animals, and activates the firing system as the sight is perfect.

According to another specification of the invention, a digital dial indicator is built in the butt-end or elsewhere to indicate the number of cartridges fired.

The operation of the electric control weapon designed according to the invention, is characterized by the fact that the sudden discharge of the condenser is transmitted to a metal button located where the rifle's hammer can usually be found, the circuit being closed by the backlash of the barrel, closely associated with the cartridge case.

According to another specification of the invention, the metal button which replaces the traditional hammer presses firmly on the bottom of the cap upon firing, without punching that bottom.

According to another specification of the invention, the metal button which replaces the traditional hammer punches the bottom of the cap upon firing of the rifle, and comes in contact with a filament terminal, the other terminal of that filament being grounded through the bottom of the cartridge.

According to a specification of the invention, the sudden discharge of the condenser brings to incandescence the bottom of the cartridge.

The cartridge cap required by the invented weapon includes a filament which is in direct contact with the powder, and connected between a cylindrical metal body and an axial electrode extending all the way to the back end of the bottom.

According to another specification of the invention, the filament is a metal wire.

According to a variation of the invention, the filament is made of a metal layer resting on an insulating material.

According to another variation of the invention, the filament is made of a metal fuse foam.

According to another specification of the invention, the weapon includes a fixed assembly, including at least the butt-end, and a mobile assembly including at least a breech, the necessary guiding systems being provided to allow for the respective sliding of both assemblies in parallel to the barrel's axis, whereas shock-absorbing systems are provided to reduce the lengthwise motions of both assemblies.

According to another specification of the invention, the first assembly, which includes the barrel and the breech, is mounted so as to slide on a guide which is rigidly mounted with the second assembly, this second assembly including the butt-end.

According to another specification of the invention, the shock-absorbing system include a helical spring which is compressed between both assemblies, and at least one pneumatic chamber limited by a cylinder and a piston, which are respectively rigidly mounted with both assemblies; this chamber includes a calibrated inlet, and it gets filled as both assemblies get closer one to the other.

According to a variation of the invention, the shock-absorbing systems include at least one helical spring, compressed between both assemblies, and a friction system designed to reduce the intersliding of both assemblies.

According to another specification of the invention, the friction system includes a plate which is rigidly mounted with one of the two assemblies, and two cross shoes mounted so as they can slide on above the other together, each shoe including a friction lining on its plate contact surface, whereas the springs continuously apply the shoes on either side of the plate.

According to another specification of the invention, in the case of a double barrel weapon, each shoe consists of a piston which limits a chamber that communicates with the loading chamber, so that the pressure rise caused by the firing of a cartridge increases the tightening force of one of the shoes on the plate.

According to a variation of the invention, in the case of a double barrel weapon, the friction system includes:

two flat contact surfaces rigidly mounted with one of the two assemblies and facing each other;

a cross bore built in the other assembly and extending between both friction surfaces;

two shoes mounted so as to slide in the cross bore, each one at one end of this bore, and each shoe including a friction lining on its respective contact surface;

a central piston mounted so as to slide in the cross bore;

on each face of the central piston, an axial nipple which can stop on either shoe;

around each axial nipple, at least one spring washer compressed between the central piston and one of the shoes;

two tubes, each one leading to a loading chamber and another chamber limited by one of the shoes and the central piston.

According to a variation of the invention, the first assembly consists of a breech, whereas the second assembly includes the weapon's barrel and butt-end, the breech being mounted so as to slide in the barrel and continuously returned forward by a helical spring, the ceiling surface separating the barrel from breech case being located ahead of the loading chamber.

According to another variation of the invention, two spinners are mounted so as to spin on a small carriage that slides freely along the barrel, each spinner being rigidly mounted with a gear meshing with a longitudinal rack rigidly mounted with the barrel .

According to another variation of the invention, the breech is rigidly mounted with a small piston which enters a chamber filled with an incompressible fluid, the free end of the small piston being located behind a large piston crossed by the small one, the large piston limiting the said chamber in front and being continuously pulled back by the return springs.

According to another variation of the invention, the moving parts of the anti-recoil mechanism include magnetic masses which move following a solenoidal coiling and generating an electrical current, which can be employed to charge the batteries that feed the electronic firing system.

The cartridge cap required by the invented weapon includes a filament which is in direct contact with the powder, and connected between a cylindrical metal body and an electrode, and it is characterized by the fact that the filament is V-shaped so as to connect the central electrode to the cap body in two sections.

According to another specification of the invention, the filament is rooted close to the front end of the cartridge powder, the flame front being then propagated from the front to the back of the cartridge, which provides a complete combustion of the powder.

According to a variation of the invention, the cartridge does not include any case, and the filament which is in direct contact with the powder, in front of this powder load, is connected through electrodes to the collector rings which come flush with the external cylindrical surface of the plastic body of the cartridge.

The attached, non-scale drawing gives a better understanding of the invention's specifications.

Figure 4:
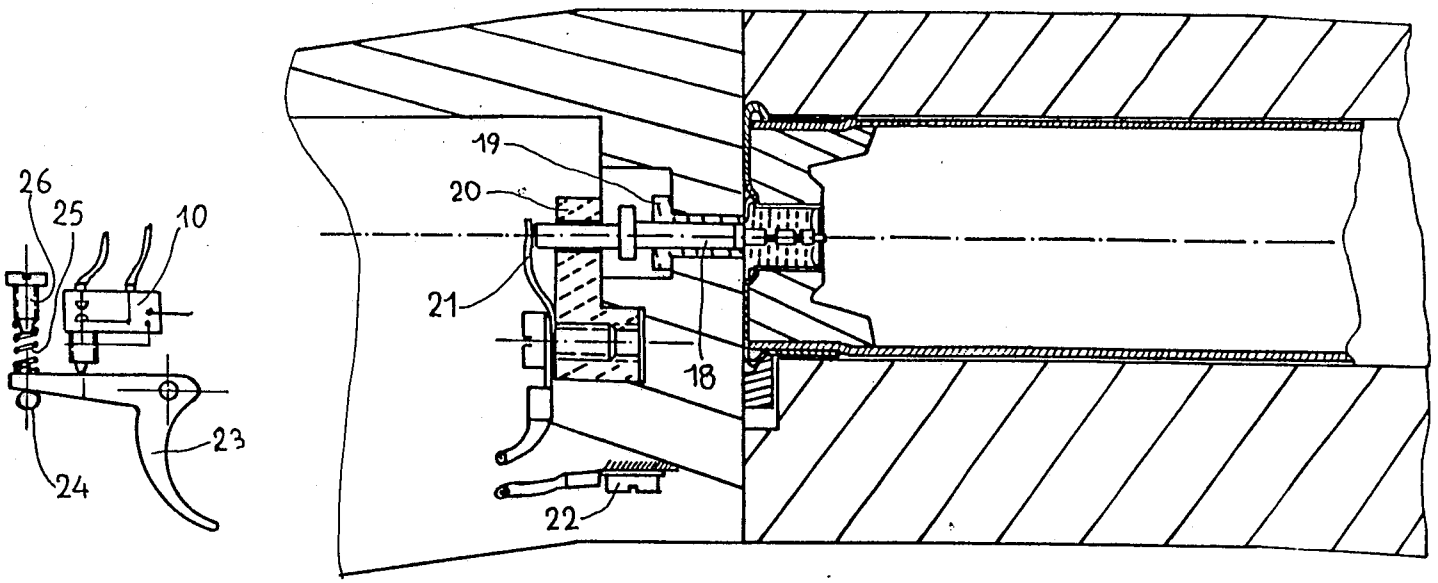
FIG. 4 is a detailed view of the weapon according to the invention, the sectional view following a vertical plan.
Figure 5:
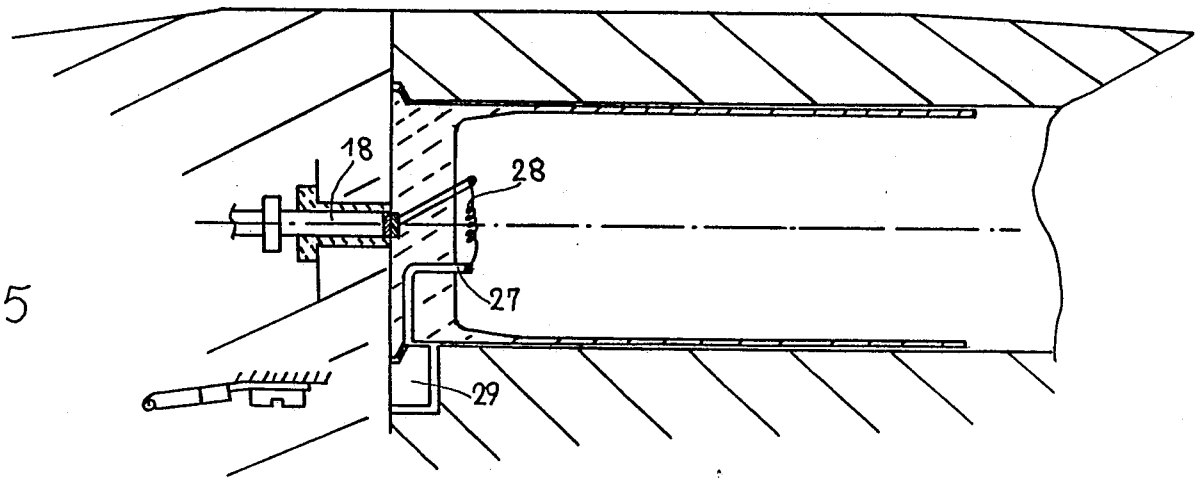

The view shown on FIG. 5 is identical to that of FIG. 4, according to a variation.

Figure 6:
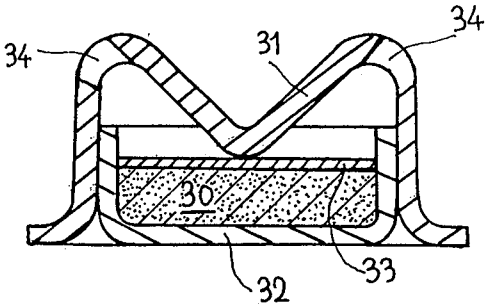
Figure 7:
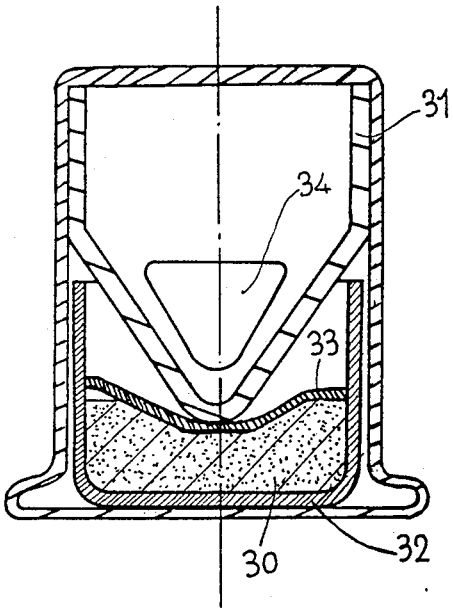

FIG. 6 and 7 show the traditional cartridge caps.

Figure 8:
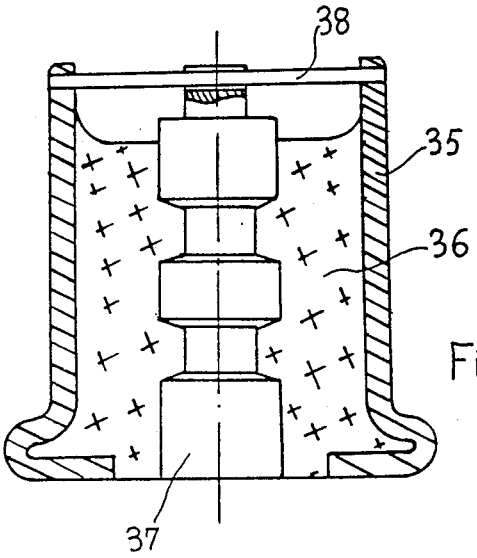

FIG. 8 is a larger scale detail of FIG. 4, showing the cartridge cap.

Figure 9:
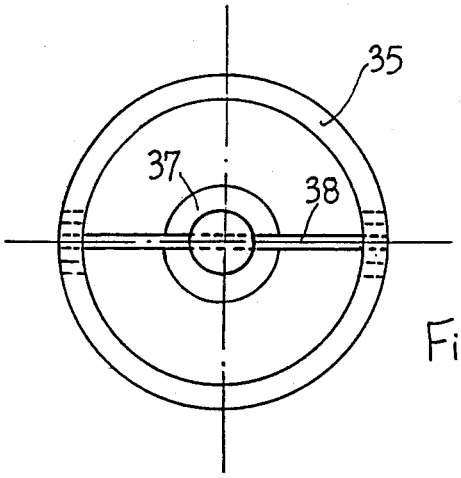

FIG. 9 shows that cap, as seen from the end.

Figure 10:
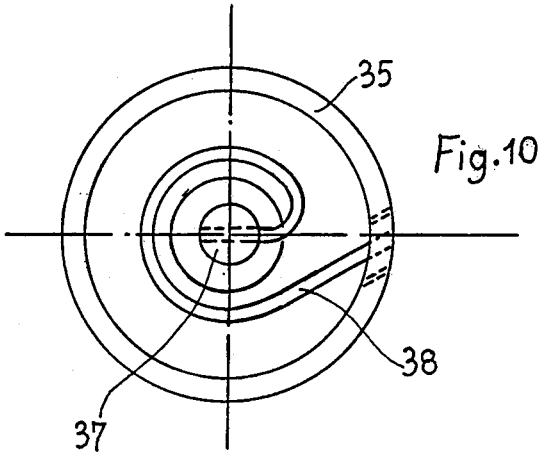

The view shown on FIG. 10 is a variation of FIG. 9, according to a variation .

The views shown on FIGS. 11 through 16 are variations of FIG. 8.

Figure 15:
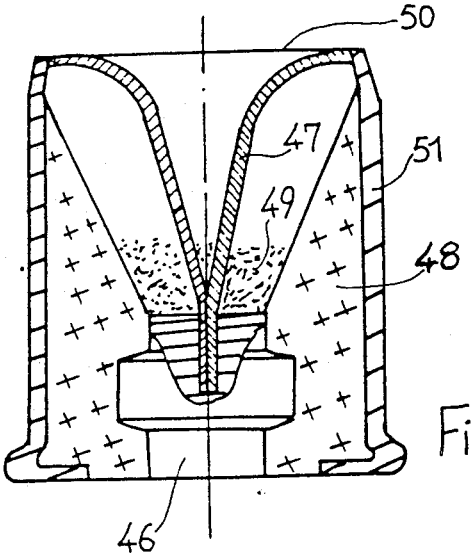
Figure 17:
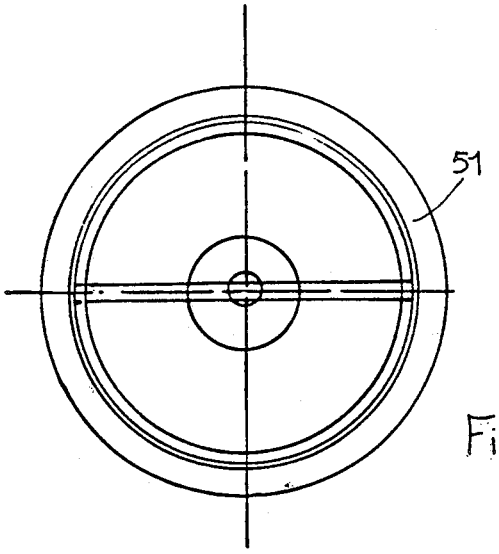

FIG. 17 is a view of the cap shown on FIG. 15, from the end.

Figure 16:
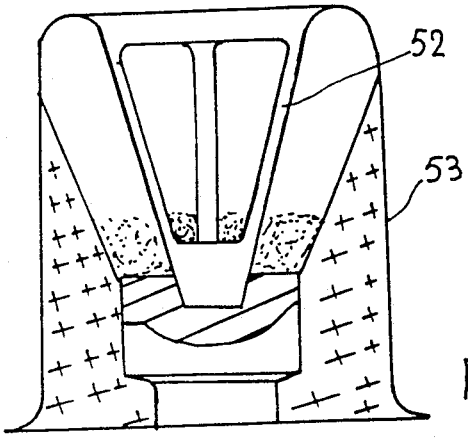
Figure 18:
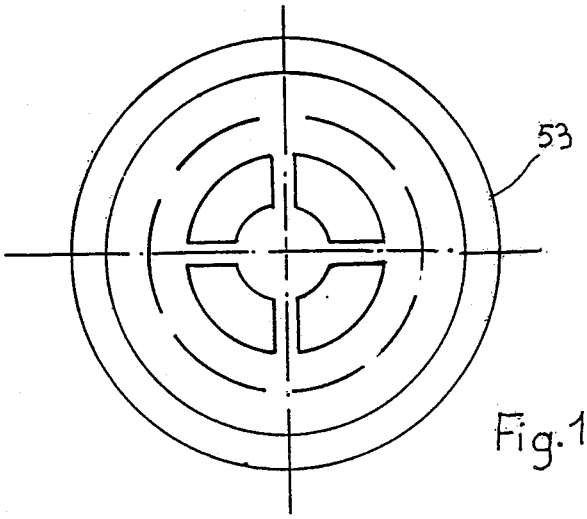

FIG. 18 is a view of the cap on FIG. 16, from the end.

Figure 19:
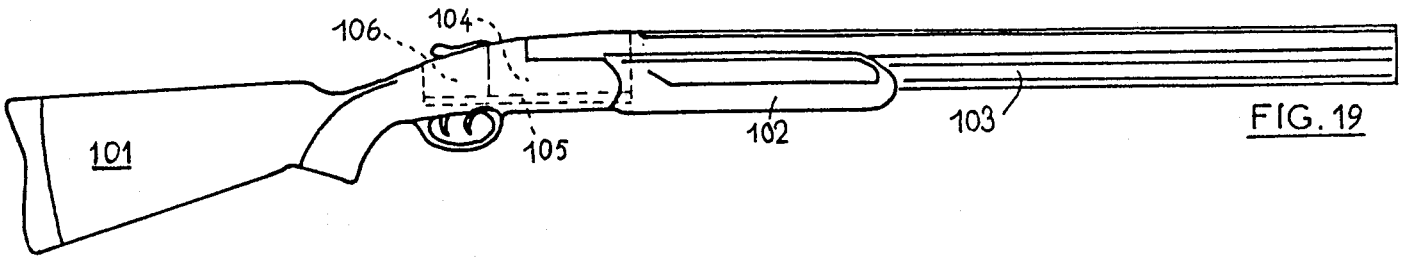

FIG. 19 is a side view of a variation of the invented weapon.

Figure 20:
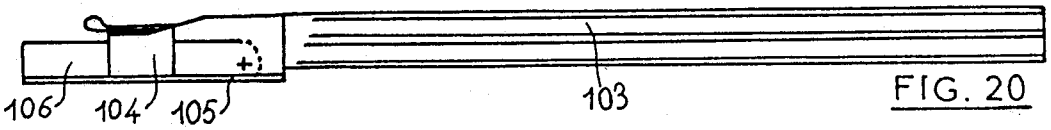
Figure 21:
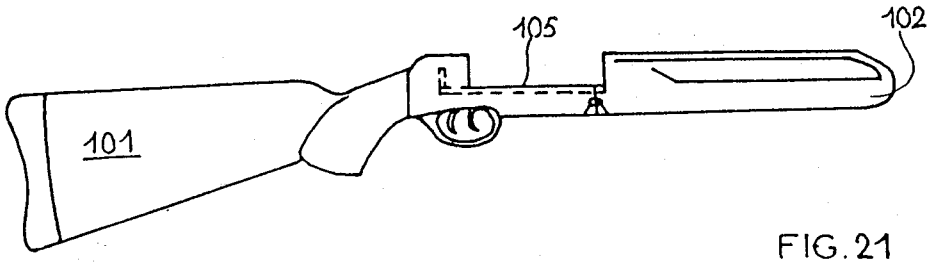

FIGS. 20 and 21 are side views of the two sub-assemblies of that weapon.

Figure 22:
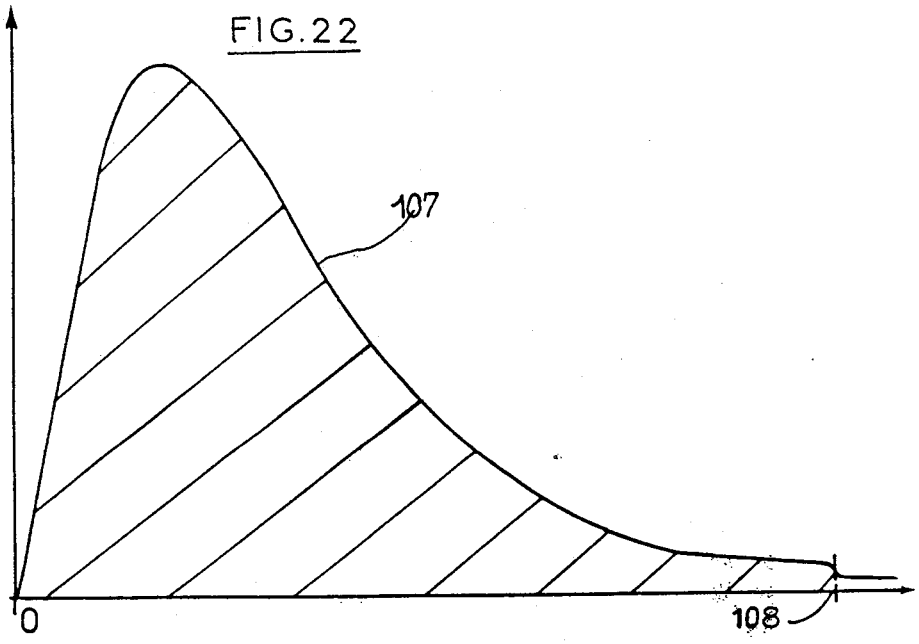

FIG. 22 is a diagram illustrating the operating specifications of a traditional weapon.

Figure 23:
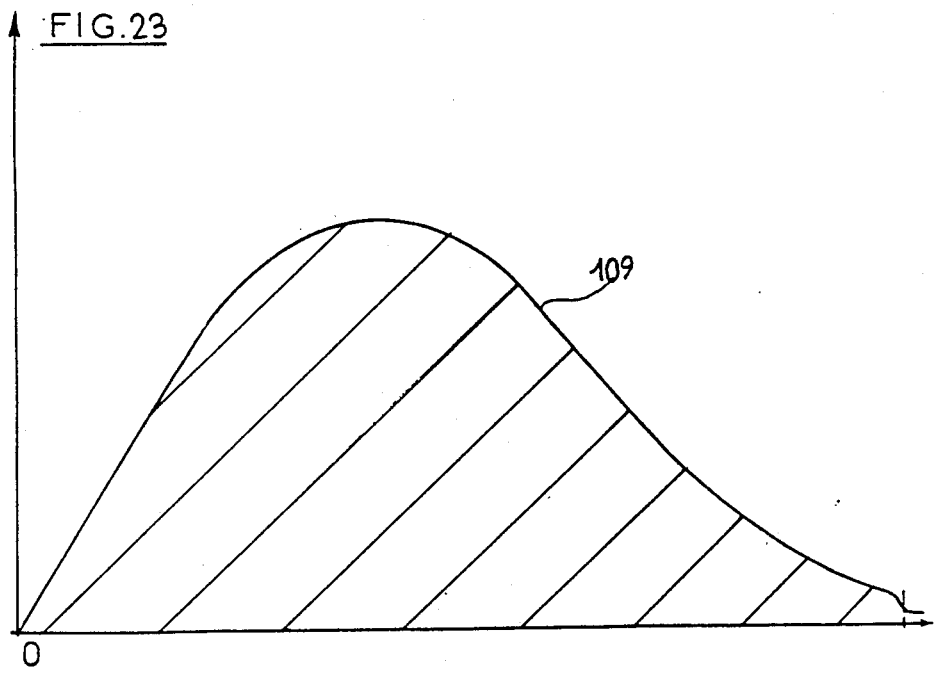

FIG. 23 is a diagram illustrating the operating specifications of the weapon according to the invention.

FIG. 24 is a side view of a variation of the invented weapon.

FIG. 25 is a side view of another variation of the invented weapon.

FIG. 26 is a view showing the weapon of FIG. 24 in cross-section following a vertical axis.

Figure 27:
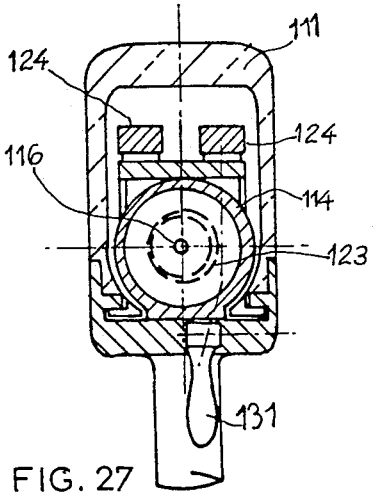

FIG. 27 is a section XXVII—XXVII (FIG. 26).

Figure 28:
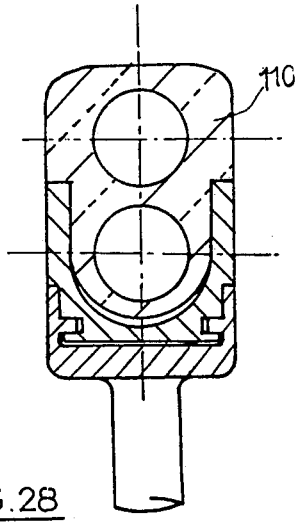

FIG. 28 is a section XXVIII—XXVIII (FIG. 26).

Figure 29:
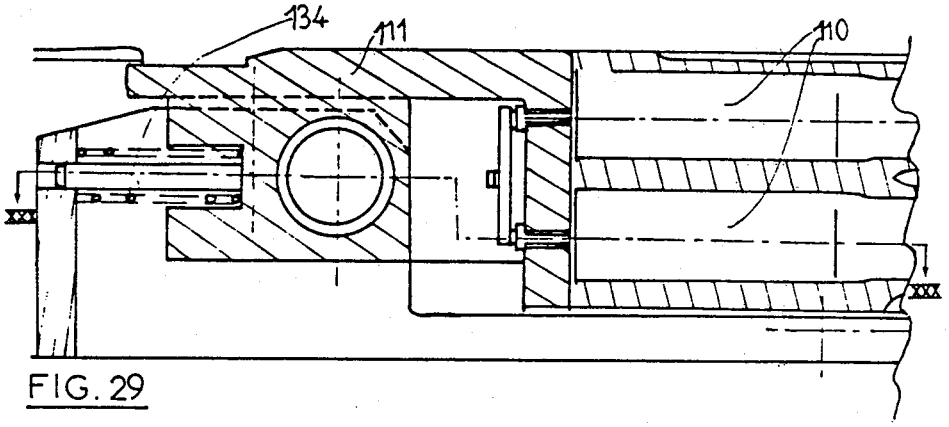

FIG. 29 is a cross-section, following the vertical axis XXIX—XXIX (FIG. 30), of a variation of the weapon.

Figure 30:
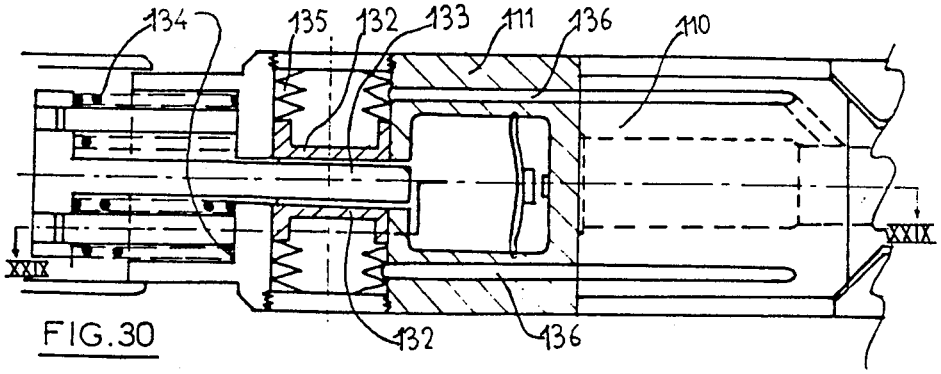

FIG. 30 is a section XXX—XXX (FIG. 29).

Figure 31:
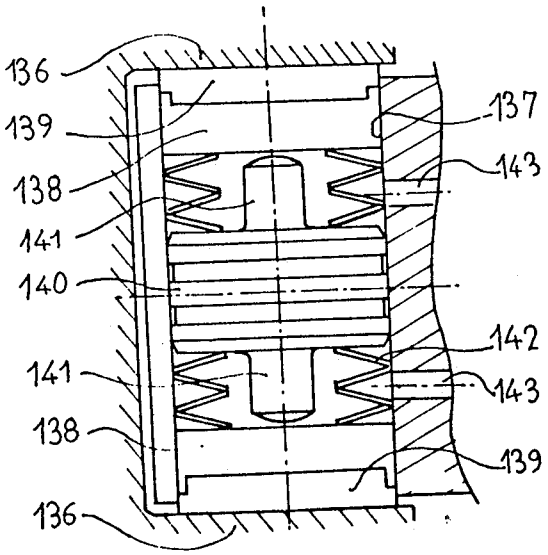

FIG. 31 is a vertical section of another variation of the weapon invented.

Figure 32:
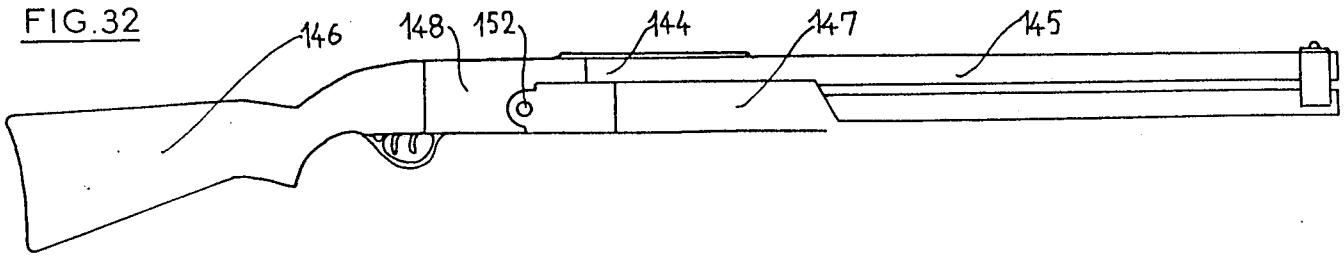

FIG. 32 is a side view of another variation of the invented weapon.

Figure 33:
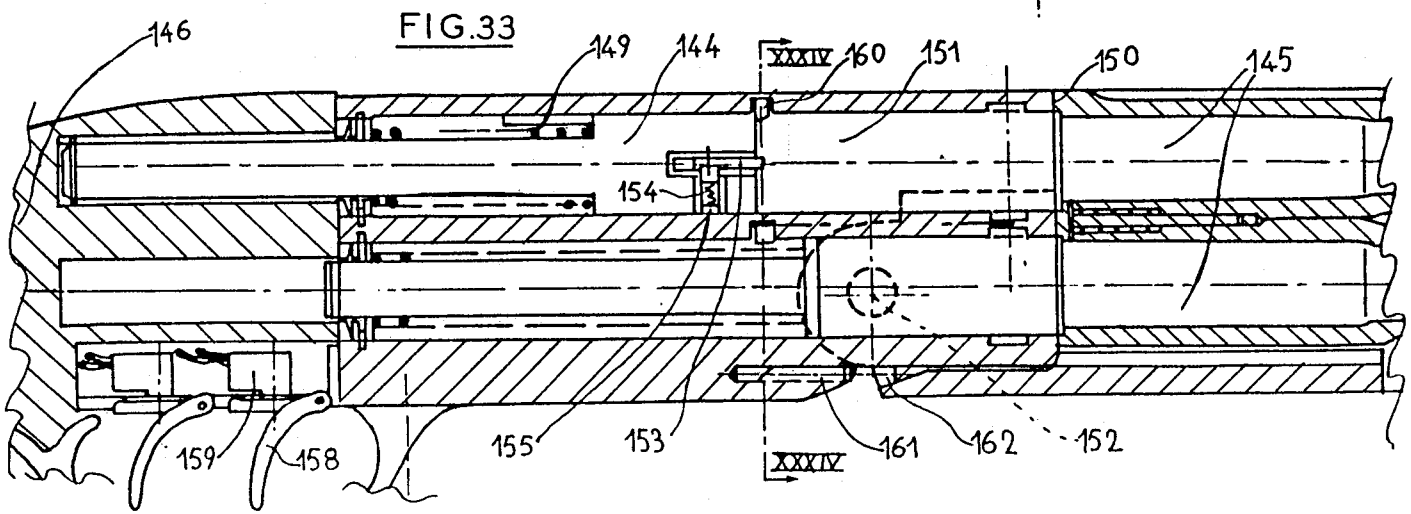

FIG. 33 is a section of the same weapon, following a vertical axis.

Figure 34:
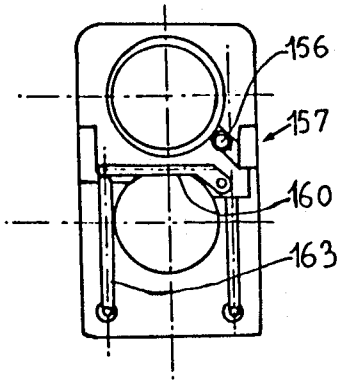

FIG. 34 is a section XXXIV—XXXIV (FIG. 33).

Figure 35:
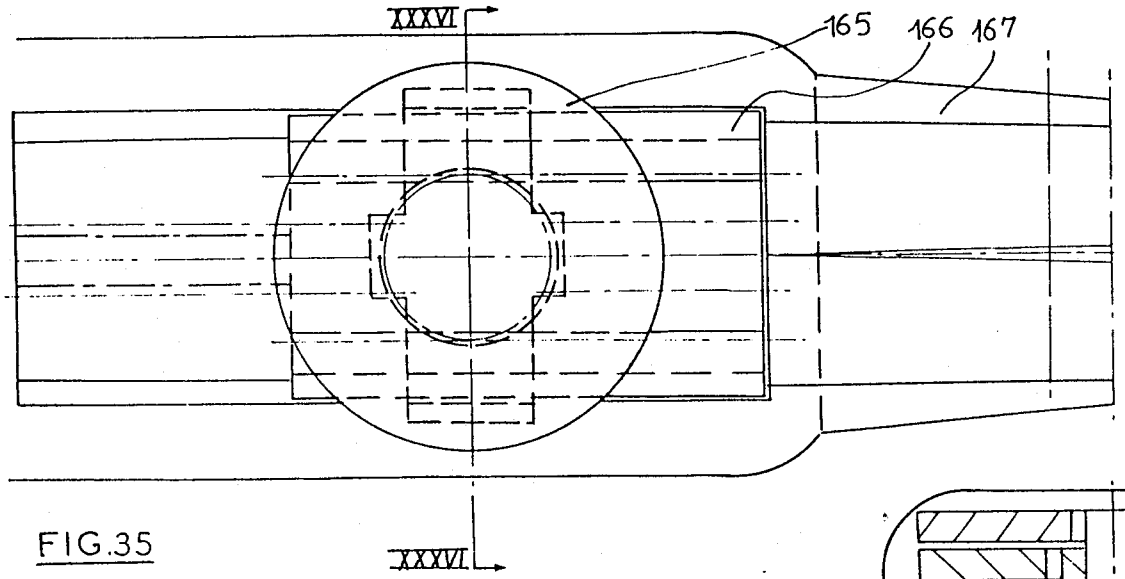

FIG. 35 is a partial top view of another variation of the invented weapon.

Figure 36:
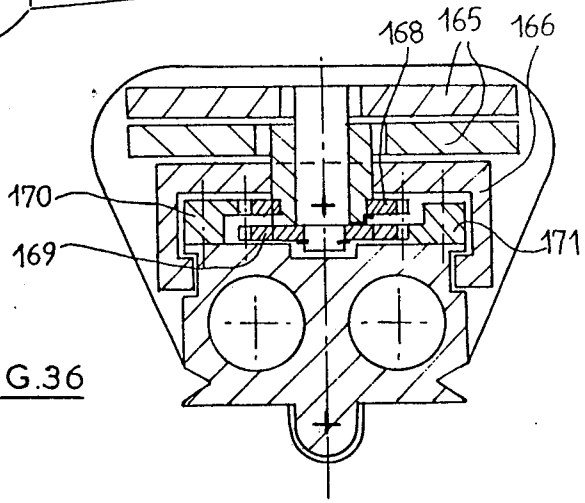

FIG. 36 is a section XXXVI—XXXVI (FIG. 35).

Figure 37:
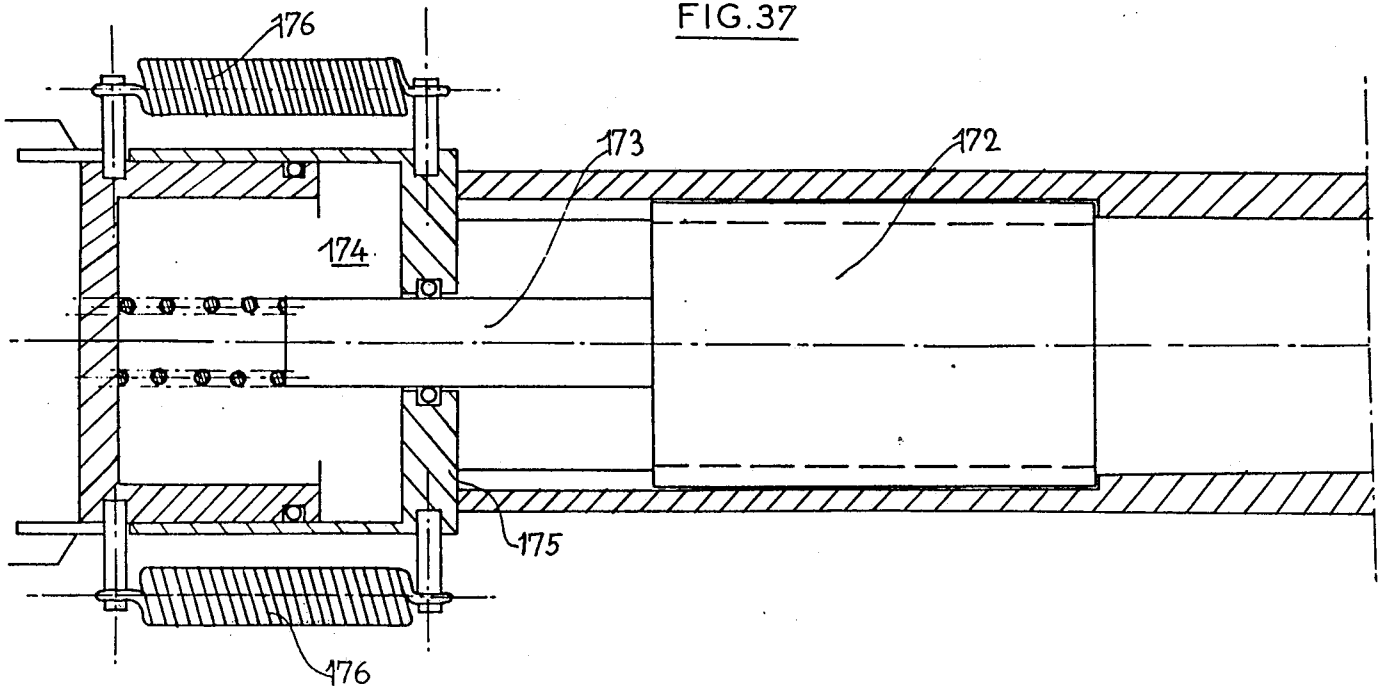

FIG. 37 is a horizontal sectional view of a variation of the invented weapon.

FIGS. 38 through 40 are axial sections of three types of caps, according to the invention.

FIGS. 41 through 43 are axial sectional views of cartridges equipped with the caps illustrated on FIGS. 38 through 40.

FIG. 44 is a cross-section of the barrel of a weapon, according to another variation of the invention.

FIG. 45 is a section XLV—XLV (FIG. 44).

FIG. 46 is an elevation view representing FIG. 44.

FIG. 47 is a view, identical to that of FIG. 45, showing a variation.

DETAILED DESCRIPTION OF PREFERRED EMBODIMENT

Figure 1:
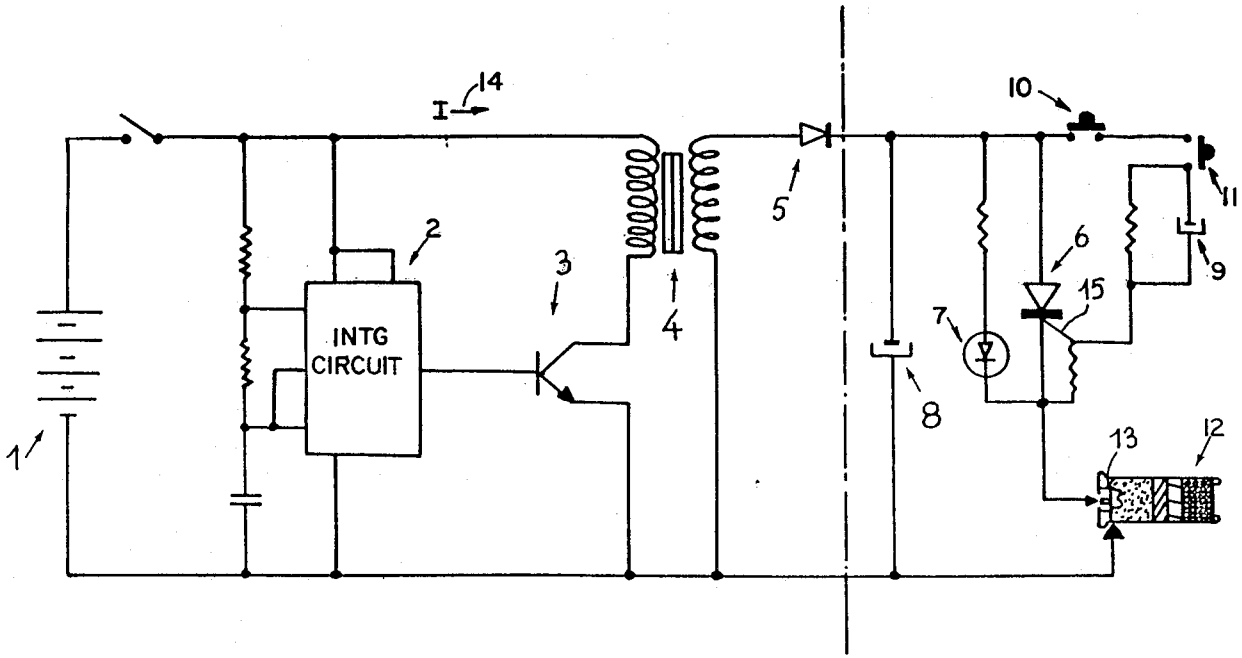
FIG. 1 is a schematic diagram of the control device of the weapon according to the invention.

FIG. 1 shows a schematic diagram of the electronic case for the firing of a weapon according to the invention. This case includes: a battery or accumulators 1, an integrated circuit 2, a transistor 3, a transformer 4, and a diode 5 in the "converter" section, along with a thyristor 6, a diode 7, condensers 8 and 9, a trigger switch 10, as well as a safety switch 11, in its "control circuit" section.

The cartridge 12, including an electrical cap 13, is very schematically illustrated: a detailed description thereof will be given herein after.

The transistor 3 is used as a switch. As it is closed, the battery 1 is directly connected to the primary coil of the transformer 4. Any voltage variation in the primary coil causes a variation of intensity, that is a variation of current in the transformer 4 core. The passage of a collector current 14 through the transistor 3 is the same as a discontinued opening and shutting of the circuit feeding the primary coil of the transformer 4. The frequency of this phenomenon is set by the integrated circuit 2, which accounts for the optimal efficiency of the transformer 4.

The voltage obtained at the terminals of the secondary coil of the transformer 4, is proportionate to the coil ratio of both coils. This voltage, corrected with the diode 5, charges the condenser 8. The thyristor 6 is used as a power relay. Therefore, as both switches 10 and 11 are simultaneously shut, the trigger 15 of the thyristor 6 is electrically activated by the condenser 9. The condenser 8 is then discharged in the electrical cap 13 of the cartridge 12 in approximately one thousandth of a second. This sudden discharge of the condenser 8 into the electrical cap 13 causes the firing.

The tests conducted have shown that with such a system, the instant electrical firing power was evaluated at about 3000 watts, this value being given as an indication only, and being non-exhaustive.

Figure 2:
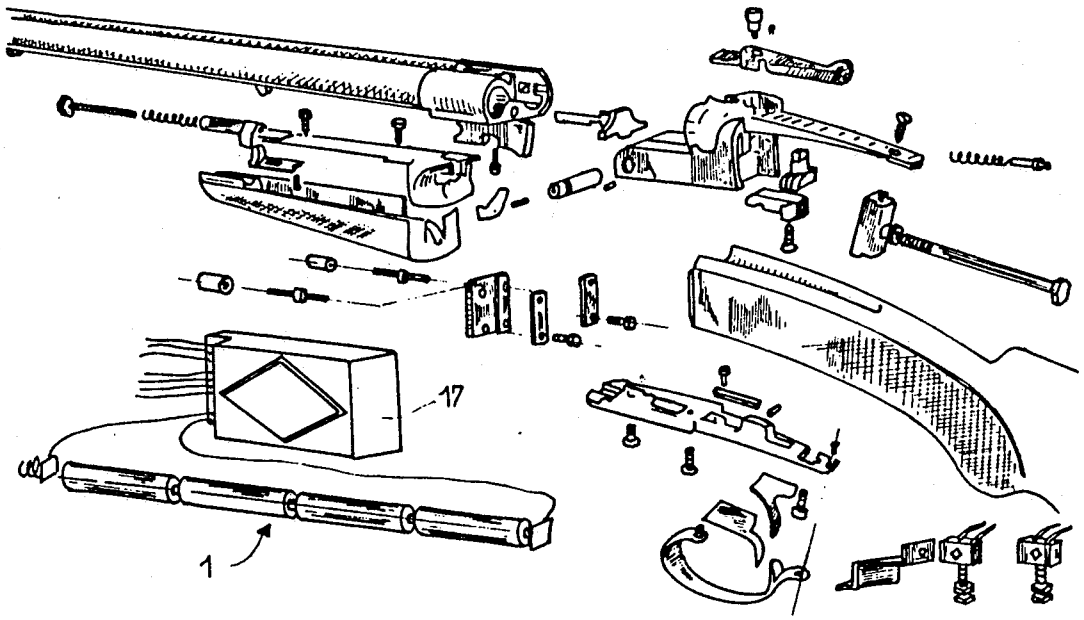
FIG. 2 is an exploded, elevated view of this weapon.
Figure 3:
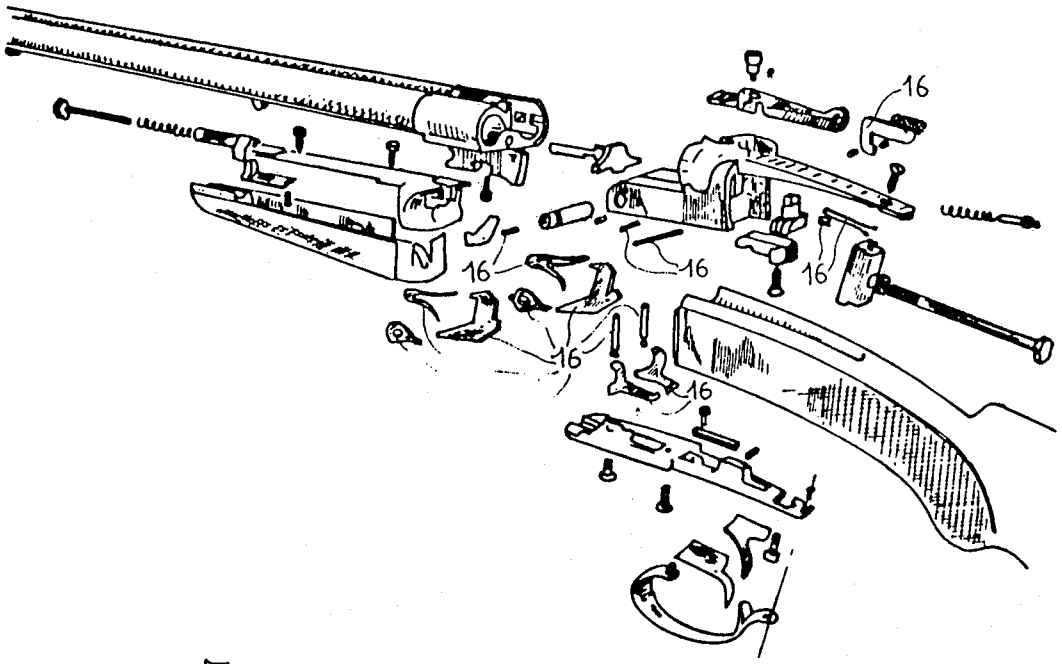
FIG. 3 is an exploded, elevated view of a traditional weapon.

When comparing FIG. 2, which represents an exploded view of a rifle according to the invention, with FIG. 3, illustrating the same rifle equipped, traditionally, with the various parts which constitute the percussion, ejection and reloading mechanism, it becomes obvious that the invention eliminates numerous complex parts. The eliminated parts are indicated on FIG. 3 with the reference 16. Among the parts that have been added on the electrical version, FIG. 2 shows the battery 1 and the case 17 schematically illustrated on FIG. 1. These components are housed and connected in the butt-end.

The experts agree that the main parts eliminated by the electrical version are delicate since they require a great precision. Furthermore, several other parts are very simplified.

The contact components are represented on FIG. 4. The figure shows that the traditional hammer is replaced by a metal key 18 which is guided in the guides 19 and 20, made of insulating material, and is continuously pushed back toward the cartridge by a spring 21. This spring is made of a highly resilient, conductible and corrosion-resistant material. The spring is connected to one of the terminals of the power circuit, the other terminal being connected to the rifle electrical ground, by a screw 22.

The switch 10, in this case, consists of a microswitch which is directly controlled by the trigger 23. The rear free end of that trigger is constantly returned to a stop against a fixed pin 24 by an helical spring 25, whose tension is adjusted by a screw 26.

Generally speaking, the parts of the rifle which are used for the contact with the ammunition are made of a metal which offers the best insolubility diagram as compared to the metal of the ammunition. For instance, if the bottom of the ammunition is made of brass, that is an alloy in which copper is dominant, the parts of the rifle that are in contact with the ammunition will be best made of tungsten or molybdenum.

The rifle cut-off tightens the spring 21 and minimizes the contact force.

According to the variation illustrated on FIG. 5, when using cartridge cases entirely made of plastic, the same contact components may be retained, but a metal insert 27 should be added at the bottom of the case in order to establish an electrical contact between one of the filament's ends 28 and the rifle ejector 29, the other end of the filament being in contact with the key 18.

As an indication, FIGS. 6 and 7 respectively show a short cap and a long cap, both types of caps being normally used for the cartridges fired with traditional hunting rifles. In both cases, a lead nitride load 30 is placed between a front anvil 31 and a rear cup 32. A thin protective sealant 33 is placed in front of the load 30, between the load and the anvil 31 which includes vents 34. The operation of the cap is a classical one: as the weapon's hammer strikes the bottom of the cup 32, the burst of mechanical power causes the lead nitride to explode and flames are released forward through the vents 34 to fire the powder contained in the cartridge.

FIGS. 8 and 9 show, on a larger scale, the structure of the electrical cap 13 illustrated on FIG. 4. This cap includes a metal tube 35 which contains an insulation 36. An electrode 37, axially placed in the cap, is entirely surrounded by the insulation 36, and it is electrically connected to the body 35 by a filament 38. The filament may consist of a straight wire diametrically oriented in front of the tube 35 and inserted both on the body 35 and the electrode 37. As shown on FIG. 10, the filament 38 may also be a coiled wire.

Therefore, considering the presence of the metal tube 35, there is a good electrical contact with the metal bottom of the traditional cartridge. This contact is perfect since the cap is fitted in the bottom.

The operation is the same as the one described above: under the sudden electrical discharge, the filament 38 heats until it becomes volatilized, and fires the powder contained in the cartridge.

FIGS. 11 through 18 show various examples of electrical caps, with some variations.

Figure 11:
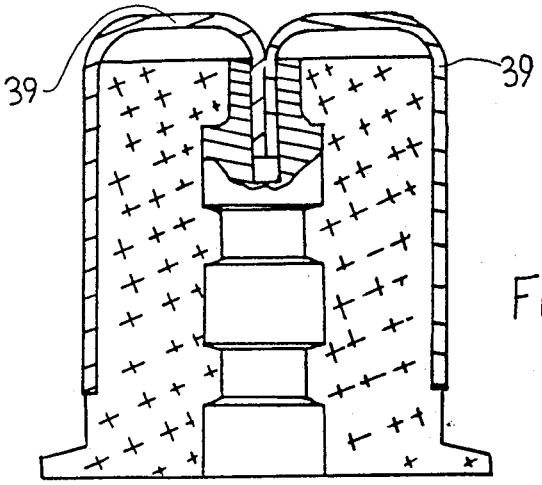

On FIG. 11 for instance, the filament consists of a very thin strip steel 39 which is also used as a cap body. Under the electrical discharge, the part of the strip which is not in contact with the bottom of the cartridge is volatilized and fires the powder.

Figure 12:
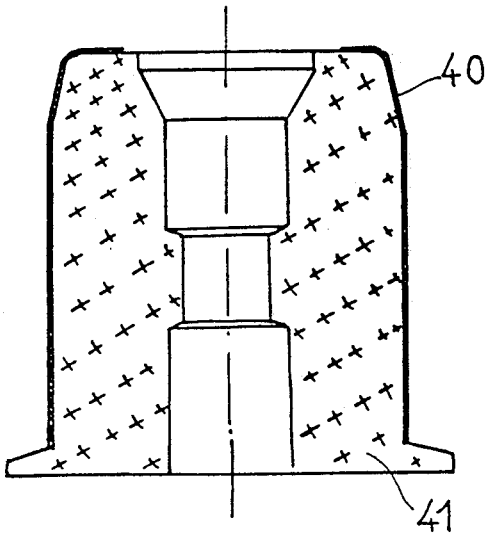

In the case of FIG. 12, the filament consists of a metal layer 40 placed on an insulating material 41. The metal layer, whose thickness may be approximately 2 microns, may be laid either through electrolysis, or by vacuum evaporation. This kind of production may be easily industralized, and easily duplicated from one cap to the other.

Figure 13:
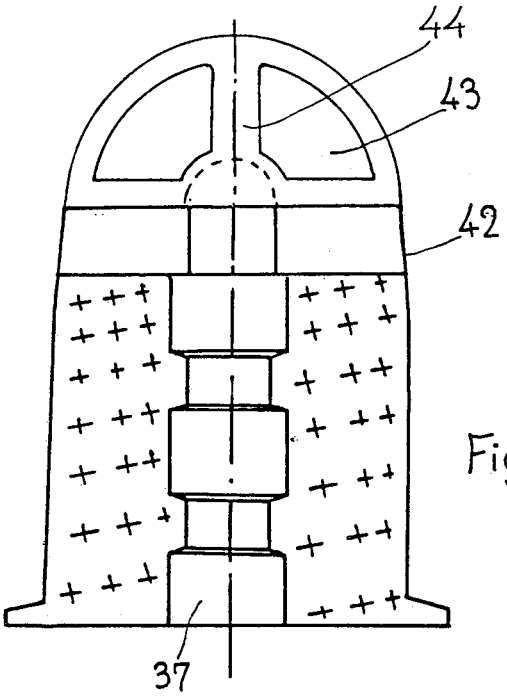

In the case of FIG. 13, the filament consists of a metal cup 42, which is very thin and whose upper part, or front part, includes cells 43 between which are located four fuses 44 (which can be seen on the folded section represented in a lighter shade). The cells minimize the metal section to be volatilized by the electrical discharge. The center front of the cap 42 is resistance-welded on the front end of the electrode 37.

Figure 14:
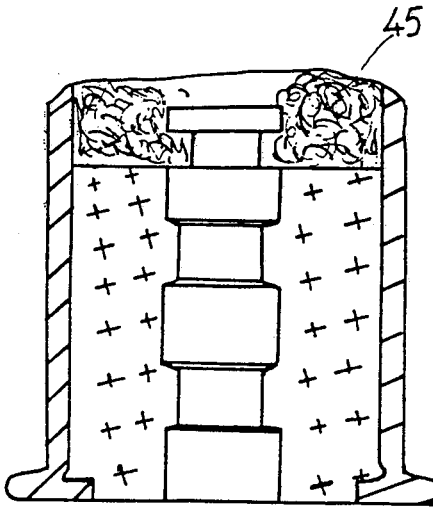

In the case of FIG. 14, the filament consists of a magnesium or tungsten-rhenium fuse foam 45 of the type used in the camera flash-bulbs.

In any case, it is possible to include, as in the traditional cap, next to the volatilization area, a quick-burning powder, this gun powder being used to increase the efficiency of the cap. This powder may be housed under the strip steel 39 of FIG. 11 and under the front part of the metal cup 42 of FIG. 13. The powder may also be contained inside the cap and kept under a thin layer of sealant located on the upper part of the cap; this system is the one which has been adopted in both of the following cases:

In the case of FIGS. 15 and 17, the electrode 46 is shorter and the filament 47 extends inside a hole provided in front of the insulating material 48. The gun powder 49 is kept in this hole by the sealant layer 50 placed against the front end of the metal tube 51.

In the case of FIGS. 16 and 18, the filament 52 consists of an extension, which is folded back over the front end of the metal tube 53.

However, experience shows that the gun powder could be eliminated from the cap, the smelting and evaporation of the filament being sufficient to suddenly light up the powder contained in the cartridge.

The use of the weapon and ammumition according to the invention, offers the following advantages:

In the case of an electrical firing, without any gun powder in the cap, the ballistics may be perfectly duplicated from one shot to another. The experts agree that this is an essential advantage. They estimate that in the case of the traditional cartridges, the ballistical differences from one cartridge to the other are caused by the fact that the gun powder cannot be quantitatively and qualitatively perfectly duplicated, and also by the fact that the powder may be altered depending on the humidity and the temperature.

The absence of gun powdeer such as lead nitride offers absolute cartridge safety, since it is well known that a traditional cartridge could be fired following an accidental shock on the weapon or on the cartridge.

By modifying the electrical discharge potential on the one hand and the diameter and/or the nature of the filament on the other hand, the cartridge's ballistics can be changed at will.

The weapon operates on simple low voltage batteries, which are very inexpensive, and still remains very efficient. Actually, the electronic case transforms the DC low voltage into a low AC voltage, then it transforms this low AC voltage into a high AC voltage through the transformer 4 (FIG. 1) this high AC voltage being then rectified so as to obtain a high DC voltage which is stored in the condenser 8. The higher this voltage, the larger the quantity of electricity stored in the condenser 8, and the better the firing. The oscillating circuit which delivers the low AC voltage could be differently designed.

FIG. 19 shows a weapon designed according to another variation of the invention. This weapon complies with the general specifications already described, but it includes both a fixed sub-assembly consisting of the butt-end 101 and the front wood 102 (FIG. 21), as well as a mobile sub-assembly including the barrel 103 and the breech 104 (FIG. 20). The slides 105 are provided to let both sub-assemblies slide lengthwise and in parallel to the axis of the double barrel, and the shock absorber 106 is provided to absorb the displacements caused by both sub-assemblies. This shock-absorbing system may be designed according to any known fashion, such as hydraulic, pneumatic, mechanical, electromagnetic and other types of shock absorbers.

Whereas the kinematics of the traditional weapons prevented the anticipation of the relative motion required for the gradual absorption of the recoil power, the new additions make possible the introduction of this additional freedom between both sub-assemblies.

This new improvement of the invention bears extremely good consequences. It was, indeed, to avoid this sudden recoil of the weapon that the experts in ballistics have adopted, for the hunting rifle as well as for the competition rifle, a pressure curve which is similar to the curve 107 on FIG. 22. On that figure, the time is entered in abscissae and the breech pressure is entered in ordinates. The initial slant is accentuated, and the shots as well as the wad come out of the barrel at a right angle above the abscissae 108, whereas the shaded area varies exactly in the same way as the shots' kinetics, that is to say that this area is limited in direct proportion of the initial speed of the shots as they come out of the barrel.

The initial speed of the shots, or any other projectile, would then be higher and the area would be larger such as the one which is limited by the curve 109 of FIG. 23, but in this case this increase of the initial speed would be upset by a more violent recoil. Such a recoil is not acceptable, particularly in a competition where the shooting frequency can be very high during the course of one afternoon.

According to a first variation, illustrated in FIGS. 24 through 27, a recoil absorbing system is obtained by compressing air packets, the weapon including two sub-assemblies which may slide independently from one another, whereas an electric conductor forms the bind which connects the two sub-assemblies.

This rifle includes one mobile sub-assembly consisting of two superimposed barrels 110 and one breech 111, as well as a fixedly sub-assembly which rests against the shoulder of the user and which consists of the butt-end 112 and the front wood 113. The butt-end 112 is rigidly mounted with a support 114, housing a piston 115 connected to the bottom of the breech 111, by a rod 116. The piston 115 is equipped with a flanged joint 117, and it limits, in a bore of the support 114, a front chamber 118 which is only connected to the outside air by a calibrated opening 119 drilled in the rod 116. A rear chamber 120, which is limited against the back wall of the support 114 inside a bell-shaped piston 121 covering the back of the support 114, is connected to the outside air through a gap provided between the cylindrical adjacent walls of the piston 121 and of the support 114.

The piston 121 is connected to the piston 115, through a rod 122 which is coaxial with the rod 116, and located behind that second rod. A helical spring 123 is compressed between the support 114 and the bottom of the breech 111.

The breech 111 also includes the electrical firing apparatus which remains unchanged. This apparatus includes mainly one switch 124 and one electrode-support 125. The two electrodes 126 are mounted on the electrode-support, and subjected to a force through the helical spring 127, so that when the barrels are locked, these electrodes provide the contact with the respective electric caps of the cartridges. The sleeves 128 and 129 are provided around each electrode to insulate it electrically from the bottom of the respective barrel, and from the electrode-support. The electrical current is brought to the electrodes by a wire 130, whose cross-section varies from 1 to 2 $mm^2$.

OPERATION

The operating principle is as follows:

As the marksman pulls the trigger 131, the switch 124 is closed by a push-rod **131*a***, which causes the activation of the trigger of the thyristor of the respective electronic circuit of the barrel concerned. This causes the volatilization of the fuse of the cap, thus firing the powder following the above detailed process.

As a result, the pressure rises in the respective barrel chamber. This sudden pressure raise causes an acceleration of the shots, according to well-defined internal ballistics and mechanical laws.

The reaction-specific to the recoil-starts from the bottom of the breech and pushes back the barrel/breech assembly. The spring 123 reduces this motion.

During the "recoil" phase, the pistons 115 and 121 are subjected to the same motion law up to the back neutral point: some air is then introduced in the chambers 118 and 120. During the "return" phase, as the mobile subassembly moves back forward under the rection force of the spring, the chambers 118 and 120 increase their pressure to break and absorb this motion until the chambers 118 and 120 reach the outside air pressure.

According to another variation of the addition illustrated on FIGS. 29 and 30, the recoil absorption is due to the friction of two parts one on the other.

In this case, the mobile sub-assembly which includes the barrels 110 and the breech 111 is braked during its reverse motions by the friction of the linings 132 on a part 133 of the fixed sub-assembly. As the mobile subassembly reaches the neutral rear point, its return forward is provided by the release of the springs 134 resting on the breech 111. The tightening force of the linings 132 on the part 133 comes from the compressed spring washers 135, also called "BELLEVILLE" washers.

According to an improvement of this variation, the tightening force is subjected to the pressure existing in the combustion chamber at the moment of the firing of the cartridge, through the ducts 136 provided between the chamber housing the cartridge and the chamber housing the brake.

According to another variation illustrated on FIG. 31, the friction system includes:

Two friction surfaces 136 which are rigidly mounted with the fixed sub-assembly and placed in front of each other;

A cross bore 137 provided in the mobile sub-assembly, this bore extending between both friction surfaces and at a right angle;

Two shoes 138 provided to slide within the cross bore 137, each one at one end of this bore, and each one including a friction lining 139 on the face which is in contact with the respective friction surface;

A central piston 140 mounted so as to slide in the cross bore 137;

On each face of the central piston, an axial nipple 141 which comes to a stop against one of the shoes;

Around each axial nipple, at least one spring washer 142 compressed between the central piston and one of the shoes;

Two ducts 143 respectively providing the communication between a chamber which receives a cartridge and another chamber limited by one of the shoes and the central piston.

This particular arrangement of the linings provide a better balance of the friction force between the mobile linings and the fixed surfaces mounted on the butt-end.

According to another variation which is not illustrated thereafter, the absorption of the recoil force is obtained by activation of a magnetic field on a polar mass.

According to another variation illustrated on FIGS. 32 through 34, the mobile sub-assembly consists of the two breeches 144 whereas the fixed sub-assembly includes the two superimposed barrels 145, the butt-end 146, the front wood 147 and the fixed breech case 148. Each breech is mounted so as to slide inside the breech case 148, which constitutes the back of the barrels, and it is continuously returned forward by the helical spring 149. At that point, the sealing surface 150 which separates the barrels from the breech case is located in front of the chambers 151 which receive the cartridges. In that case, the recoil absorption is obtained by the reverse displacement of the breech as compared to the rest of the rifle, due to the breech inertia.

Since the opening of the rifle is designed around a hinge 152 located behind the sealing surface 150, this arrangement allows more space around the openings of the breech case, and provides a forward cartridge case ejection instead of a lateral or backward ejection as in the traditional systems.

As the weapon is ready for shooting, the springs 149 exert, through the breeches 144, a preload on the cartridge cases. The keys 153, which are electrically insulated, are in contact with the respective central electrodes of the electrical caps. A spring 154 maintains this contact regardless of the dimensional variations between the breech and the cap surface. The electrical power required for the firing is brought to a distribution ring 155 by a conductor 156, whereas a device 157 including two brushes and one spring brings the necessary initial power to the central electrode. The insulation of that electric circuit is provided by a plastic material such as the bakelite or a similar material.

As the marksman pulls the trigger 158, he closes the switch 159, which activates the trigger of the thyrisor of the electronic circuit of the respective barrel, and causes the volatilization of the cap wire used to fire the powder.

As in the above example, the pressure rise in the barrel chamber causes a sudden acceleration of the shots and produces a force in the opposite direction which, in this case, rests on the breech 144, that breech being slowed in its motion toward the back by the respective spring 149.

In order to keep the case of each cartridge in the breech case, two triggers 160 have been provided. Therefore, as the case of the cartridge comes back further than the respective trigger 160, the trigger limits the forward motion of the case so as to shut it into the breech. As the hunter is about to "break" his rifle, the finger 161 will pull back under the force of the stop 162, and transmit this square-type motion to a rod 163 which will pull up the trigger 160. The case thus released will be ejected forward so as to provide a better safety for the marksman.

In any case, the rifle may be designed with a traditional gun type butt-end as shown on FIG. 24. The rifle can also successfully be designed according to the specifications of FIG. 25, that is with two control keys 164 located to the left or to the right of the handle depending on the fact that the marksman be right or left handed.

If traditional triggers are used, these triggers may be made more or less softer through the use of adjustable stops.

The fact that these slight sophistications may be introduced in the recoil brake of the electrical rifle, makes this one very advantageous since it was impossible to introduce them in a traditional weapon. For instance, the weapon recoil calls for three equally undesirable forces which are the following: the maximum force $F_M$ applied on the marksman's shoulder; the motion quantity mVn which contributes to the shock sensation felt on the shoulder; the kinetics $\frac{1}{2}$ $mV^2$ transferred to the weapon by the ejection of the shot and of the gases, and which is felt as an off-balance force.

But, according to the improvement of the electrical weapon equipped with a recoil brake, following the addition, it is possible to house, thanks to the larger freedom brought between the fixed and mobile sub-assemblies and to the lighter weight of the weapon in which the old loading and percussion systems have been eliminated, the means required to fight each one of the three nuisances.

During the tests conducted on the weapon after the addition, it has been demonstrated that, in order to reduce all of these physiological sensations, that is to reduce the three respective dimensions, three mobile assemblies are required instead of two.

Therefore, besides the two above sub-assemblies which are free one compared to the other, it is an advantage to introduce a free mobile which can use its own inertia.

FIGS. 35 through 37 show two examples of weapons designed according to this principle, and equipped with simple kinematics so that these weapons are physiologically recoilless.

In the case of FIGS. 35 and 36, two spinners 165 are mounted on a small carriage 166 which slides freely along the barrel 167. Each spinner is also rigidly mounted with a gear 168 or 169 which is meshed with a longitudinal rack 170 or 171 rigidly mounted with the barrels.

In this case, during the backward recoil, the reaction exerted by all of these assemblies on the barrel is converted into a rotation power on the spinners.

Following the example of FIG. 37, the breech 172 is rigidly mounted with a small piston 173 which is engaged in a chamber 174 filled with an incompressible fluid. Therefore, the small piston crosses a large piston 175, its free end being located behind the large piston which limits the front end of chamber 174. The large piston is continuously subjected to the return springs 176 which pull it backward.

In this case, the end of the recoiling assembly has a tendency to reduce the available volume in chamber 174, the compression of this chamber throwing forward the large piston 175. The springs 176 which tie both end walls of the chamber 174 absorb, when stretched, the desirable part of kinetics.

According to another variation which is not illustrated, the moving parts of the anti-recoil mechanism include magnetic masses which, as they move in a solenoid coil, produce an electric current which can be employed to reload the batteries feeding the electronic firing system.

The basic patent application describes several types of short electric caps comparable to the cap of FIG. 38 in which an exploding powder load 177 is used, such as the black powder or "booster", which boosts the firing process.

Recent tests have made it possible to check that the use of that relay-powder was not required if a cap such as shown on FIG. 39 was used. This cap includes a metal part 178 and a central electrode 179 which extends several millimeters above the cap. This electrode is mechanically maintained, and it is electrically insulated by a plastic material tube 180. The filament 181, which is V-shaped, connects two sections of the central electrode 179 to the body 178 of the cap. The filament 181 is in direct contact with the powder.

Upon firing, the "breakage" of the filament inside the powder load provides a direct start of combustion of that powder. In both cases, the choice of the powder will depend on a pressure/time factor, as explained above. The propagation wave of the flames according to this position of the filament occurs at a right angle up to this filament. This propagation wave will particularly affect the barrel chamber.

According to a variation illustrated on FIG. 40, the filament 182 is still in direct contact with the powder, but it is placed close to the front end of the powder load of the cartridge (refer to FIG. 43). Therefore, the filament is mounted between the two free ends of the long electrodes 183.

This position provides a propagation of the flames following the axis of the cartridge, but, this time, unlike the traditional processes, from the front to the back. Therefore, whereas the traditional processes do not always provide a total combustion of the powder load, this position allows inasmuch as the flame is propagated, in the reverse direction, and this allows for an improved ballistic efficiency of the load.

It should be noted that it is possible to mount these caps on traditional cartridge cases without changing the design of the automatic loading machines of the cartridges, as shown in FIGS. 41–43 corresponding to the caps shown in FIGS. 38–40, respectively.

According to another variation illustrated in FIGS. 44 through 46, the cartridge does not include a case, whereas a filament 184, in direct contact with the powder load, at the front end of this load, is connected by the electrodes 185 and 186 to collector rings 187 and 188 which come flush to the cylindrical external surface of the plastic body 189 of the cartridge. At the level of the collector ring 187, the barrel includes an internal insulating ring 190, whereas a radial contact piece 191 provides the contact with the ring 187 by moving toward the axis of the barrel. This motion of the piece 191 is caused by the forward motion of a longitudinal rod 192 as the rifle is cut off, with respect to the piece 191 and the rod 192 a 450 slide surface is provided between these two parts. The collector ring 188 comes in direct contact with the barrel, to be thus connected to the electrical ground of the rifle. The pressure which provides the electric contact on the electrodes is obtained by a slight enlargement of the external diameter of the cartridge with respect to the internal diameter of the barrel, and which represents approximately a few tenths of millimeter. The cartridge inserting force is obtained by the sectional variation between the chamber which surrounds the powder and the rest of the barrel.

Therefore, as the cross-wall 193 of the body 189, which constitutes the propelling piston of the load, becomes sealed because of the sectional variation of the barrel. This piston pulls the body 189, and the shots contained in the cartridge are released as the cartridge comes out of the barrel, under the action of the speed on the chamber containing the shots and also by means of the tearing caps provided on the wall of the body 189.

According to another variation illustrated on FIG. 47, it is also possible to design a caseless cartridge, with a filament 194 maintained between electrode 195 and 196 rigidly mounted on a back cover mounted on the plastic body of the cartridge. The cartridge body can also be made of waxed cellulose or any other biodegradable or self-consuming material.

Having described the invention, what is claimed is:

1. An electrically controlled weapon having at least one barrel comprising:
   - a cartridge receivable in the barrel, said cartridge having a powder charge and a resistive element disposed proximate said powder charge;
   - generator means for generating a high voltage DC current;
   - at least one capacitor charged by said high voltage DC current;
   - an electronic switch connected between said capacitor and the resistive element of said cartridge; and
   - a mechanical switch for generating an electrical signal activating said electronic switch to discharge said at least one capacitor through said resistive element, volatilizing said resistive element and igniting said powder charge.

2. The weapon of claim 1 wherein said generator means comprises:
   - at least one battery providing a low voltage DC current;
   - oscillator circuit means for converting said low voltage DC current to a low voltage AC current;
   - transformer means for amplifying said low voltage AC current to generate a high voltage AC current; and
   - rectifier means for converting said high voltage AC current to generate said high voltage DC current.

3. The weapon of claim 2 wherein said electronic switch is a thyristor having a trigger electrode and wherein the signal generated by said mechanical switch is applied to said trigger electrode causing said thyristor to become conductive.

4. The weapon of claim 2 wherein said weapon has two barrels and a cartridge receivable in each of said barrels, said system includes a second capacitor, a second electronic switch and a second mechanical switch for said second barrels so that one of said capacitors may be charged while the other is being discharged.

5. The weapon of claim 1 or 4 further including a first circuit breaker in circuit relationship with said mechanical switch which remains closed as long as the weapon is not locked and a second circuit breaker in series with said battery which is closed to activate said generator means.

6. The weapon of claim 1 wherein said mechanical switch is activated by a traditional pull type trigger.

7. The weapon of claim 1 wherein said mechanical switch is a pressure actuated switch.

8. The weapon of claim 1 wherein said cartridge has an axially disposed electrical contact attached to one end of said resistive element, said weapon includes a metal key resiliently engaging said electrical contact, and wherein said capacitor is discharged through said electronic switch and said metal key and said resistive element.

9. The weapon of claim 8 wherein the volatilization of said resistive element by the discharge of said capacitance ignites said powder at the bottom of said cartridge.

10. The weapon of claim 8 wherein said cartridge includes a firing cap, axially disposed at one end of said cartridge, said resistive element is housed in said firing cap.

11. The weapon of claim 10 wherein said firing cap comprises:

a cylindrical metal body;

a center electrode;

insulator material axially supporting said center electrode within said cylindrical body; and wherein said resistive element is disposed between said center electrode and cylindrical metal body adjacent to said cartridge's powder.

12. The weapon of claim 11 wherein said resistive element is a metal wire filament.

13. The weapon of claim 11 wherein said resistive element is a thin layer of metal disposed over the surface of said insulator material.

14. The weapon of claim 11 wherein said resistive element is a melting metal foam.

15. The weapon of claim 11 wherein said resistive element is a thin strip of steel contiguous with said metal cylinder.

16. The weapon of claim 11 further including a charge of exploding powder adjacent to said filament, and a thin layer of sealant sealing said exploding powder within said cap.

17. The weapon of claim 1 wherein said weapon has a fixed assembly consisting of at least a butt-end, a movable assembly including at least a breech and the barrel and means for providing relative sliding motion between said fixed and movable assemblies parallel to the axis of said barrel, said weapon further includes shock-absorbing means for absorbing the relative motion of said fixed and movable assemblies along the axis of said barrel.

18. The weapon of claim 17 wherein said means for providing relative sliding motion comprises:

a guide formed in said fixed assembly parallel to the axis of said barrel;

a guide follower attached to said breech and barrel adapted to slide along said guide in a direction parallel to the axis of said barrel.

19. The weapon of claim 17 wherein said shock-absorbing means comprises:

a helical spring compressed between said fixed and movable assemblies;

at least one cylinder attached to one of said fixed and movable assemblies;

at least one piston disposed in said at least one cylinder and attached to the other of said fixed and movable assemblies; and a calibrated opening connecting the inside of said at least one cylinder to the outside air.

20. The weapon of claim 17 wherein said shock-absorber means comprises:

at least one resilient member compressed between said fixed and movable assemblies; and means for frictionally retarding the movement between said fixed and movable assemblies in response to the firing of said cartridge.

21. The weapon of claim 20 wherein said means for frictionally retarding comprises:

at least one member attached to said fixed assembly having a lateral surface parallel to the axis of barrel;

piston means having a friction pad engaging said lateral surface in response to an increase in a received pressure; and a duct interconnecting said piston means with the inside of said barrel forward of said cartridge, said duct communicating to said piston means the pressure increase in said barrel due to the firing of said cartridge.

22. The weapon of claim 21 wherein said weapon has a second barrel, said means for retarding has a second piston means and a second duct interconnecting said second piston means with the inside of said second barrel forward of said cartridge.

23. The weapon of claim 20 wherein said weapon has two barrels, said means for frictionally retarding comprises:

two parallel and facing friction surfaces fixedly attached to said fixed assembly;

a cross bore in said movable assembly extending between said two friction surfaces;

two shoes disposed in said cross bore, one at each end of said bore and frictionally engaging said two friction surfaces;

a central piston slidably disposed in said cross bore between said two shoes, said central piston having a coaxial nipple on each side extending towards said two shoes;

a pair of spring members resilienty biasing said central piston between said two shoes;

a first duct connecting one end of said cross bore with the inside of one of said two barrels; and a second duct connecting the other end of said cross bore with the inside of the other of said two barrels.

24. The weapon of claim 1 wherein said weapon has a fixed assembly consisting of at least a butt-end and at least one barrel and a movable assembly consisting of at least one breech, said weapon further including:

a breech case fixedly attached to said barrel, said breech case including means for guiding the movement of said breech in direction parallel to the axis of the barrel; and resilient means for generating a force urging said breech toward said barrrel.

25. The weapon of claim 1 further including:

a free carriage slidably attached to the barrel;

a rotor having an axial shaft rotatably attached to said free carriage;

a gear fixedly attached to said axial shaft; and a longitudinal rack fixedly attached to said barrel and engaging said gear.

26. The weapon of claim 17 wherein said shock-absorber comprises:

a cylinder attached to said fixed assembly;

a large piston cooperating with said cylinder to define a closed fluid chamber, said large piston having an axial aperture;

an incompressible fluid filling said fluid chamber;

a small piston attached to said movable assembly received in said fluid chamber through the axial aperture in said large piston; and means for resiliently biasing said large piston in a direction tending to reduce the volume of said fluid chamber.

27. The weapon of claim 11 wherein said center electrode is longer than said cylindrical metal body and wherein said resistive element is two radially opposite filaments connected between said center electrode and said metal body and in direct contact with the cartridges powder charge.

28. The weapon of claim 11 wherein the resistive element is a filament located proximate the front end of cartridges powder charge causing the powder to burn within the cartridge from front to back.

29. The weapon of claim 8 wherein the case of said cartridge is made from a nonconductive material, and said resistive element is located close to the front end of the cartridge's powder charge, said cartridge further includes:

a first collector ring flush with the external surface of said cartridge and connected to one end of said resistive element;

a second collector ring flush with the external surface of said cartidge and displaced from said first collector ring, said second collector ring connected to the other end of said resistive element; and means connecting one of said collector rings to said electronic switch and connecting the other collector ring to a common ground.

* * * * *

UNITED STATES PATENT AND TRADEMARK OFFICE

CERTIFICATE OF CORRECTION

PATENT NO. : 4,332,098

DATED : June 1, 1982

INVENTOR(S) : Serge Estenevy

It is certified that error appears in the above—identified patent and that said Letters Patent is hereby corrected as shown below:

Column 2, Line 41, Delete "then" and insert --- than ---

Column 3, Line 37, Delete "system" and insert ---systems ---

Column 3, Line 52, Delete "on" and insert ---one ---

Column 8, Line 31, Delete "powdeer" and insert ---powder---

Column 9, Line 33, Delete "fixedly" and insert --- fixed ---

Column 10, Line 64, Delete "provide" and insert --- provides ---

Column 16, Line 28, Delete "resilienty" and insert --- resiliently ---

Signed and Sealed this

*Twenty-fifth* Day of *January 1983*

[SEAL]

*Attest:*

GERALD J. MOSSINGHOFF

*Attesting Officer*

*Commissioner of Patents and Trademarks*